US006314688B1

(12) United States Patent
Ford et al.

(10) Patent No.: US 6,314,688 B1
(45) Date of Patent: Nov. 13, 2001

(54) ARCHITECTURAL PROTECTION DEVICES AND SYSTEM AND METHOD UTILIZING SAME

(75) Inventors: Russell H. Ford; John H. Knickerbocker, both of Seattle, WA (US)

(73) Assignee: Ravensforge LLC, Seattle, WA (US)

( * ) Notice: Subject to any disclaimer, the term of this patent is extended or adjusted under 35 U.S.C. 154(b) by 0 days.

(21) Appl. No.: 09/203,976

(22) Filed: Dec. 2, 1998

(51) Int. Cl.[7] ..... E04F 19/00

(52) U.S. Cl. ..... 52/101; 52/288.1; 52/718.01

(58) Field of Search ..... 52/101, 102, 287.1, 52/288.1, 716.1, 716.5, 716.6, 716.7, 718.01, 718.05, 718.02, 717.06; 256/1, 11, 12, 14, 17, 18; D8/403; 206/453; 404/9, 15

(56) References Cited

U.S. PATENT DOCUMENTS

| | | | | |
|---|---|---|---|---|
| 172,485 | * | 1/1876 | Potter | 52/288.1 |
| 985,898 | * | 3/1911 | Jameson | 52/287.1 |
| 1,479,651 | * | 1/1924 | Clements | 404/9 |
| 3,181,176 | | 5/1965 | Nagy et al. | 4/1 |
| 4,249,832 | * | 2/1981 | Schmanski | 404/9 |
| 4,338,041 | * | 7/1982 | Schmanski | 404/9 |
| 4,779,862 | | 10/1988 | Keppler | 272/70 |
| 5,181,695 | * | 1/1993 | Arthur | 404/9 |
| 6,044,601 | * | 4/2000 | Chmela et al. | 52/287.1 |
| 6,086,286 | | 7/2000 | Loarie et al. | 404/7 |

FOREIGN PATENT DOCUMENTS

| | | | | |
|---|---|---|---|---|
| 26 56 300 A1 | | 6/1978 | (DE) . | |
| 28 04 855 A1 | | 8/1979 | (DE) . | |
| 34 01 768 A1 | | 8/1985 | (DE) . | |
| 4300154 | * | 7/1994 | (DE) | 52/101 |

* cited by examiner

*Primary Examiner*—Michael Safavi
(74) *Attorney, Agent, or Firm*—Dorsey & Whitney LLP

(57) ABSTRACT

A protection device is for restricting an object from sliding along an edge formed by a pair of surfaces of a structure. The protection device includes an obstruction fixture having a mounting surface and a body projecting away from the mounting surface, and a fastener securing the mounting surface to at least one of the surfaces of the structure. The obstruction fixture is positioned on the structure with the body positioned sufficiently close to the edge such that the object sliding along the edge will contact the body.

10 Claims, 11 Drawing Sheets

ARCHITECTURAL PROTECTION DEVICES AND SYSTEM AND METHOD UTILIZING SAME

TECHNICAL FIELD

The present invention pertains to architectural protection devices, and in particular to obstruction fixtures for preventing damage to edges of structures caused by sliding skateboards, in-line skates, and similar devices along the edges of the structures.

BACKGROUND OF THE INVENTION

Skateboarding and in-line skating are activities in which it is common to attempt to " push the envelope" by doing ever more elegant and risky acrobatic-type stunts. One such stunt commonly done by both skateboarders and in-line skaters involves jumping onto and sliding along the edge of a structure, such as a low retaining wall, a large planter, or stairs. Usually, the skateboarder or in-line skater picks up speed, approaches one end of the structure, jumps up onto the structure with either the end of the skateboard or the wheels of the in-line skates, slides along the edge, and finally drops off the other end of the structure and continues along the way.

Although probably great fun for the skateboarder or in-line skater, these stunts are disliked by property owners because they inflict damage on the structures. Large pieces of the edge can be chipped off by the initial impact of the skateboard or skates, and over time abrasion caused by the sliding motion along the edge will wear down the edge. The result in either case is a disfigured edge, which is aesthetically unappealing and which must be repaired, potentially at great cost.

Aside from the damage these stunts do to the structure, they also may create unwanted legal liability for the property owner in the event one of the budding stunt persons is injured while performing a stunt or injures an innocent third party. Thus, it is in the property owner's interest to prevent sliding along the edges of structures.

There is thus a need for a device that restricts, and therefore discourages, sliding along the edge of a structure while preserving the aesthetic qualities of the structure and allowing legitimate uses of the structure. Several devices have been used, each having its shortcomings.

The first device that could be used is a hand railing installed along the edge of the structure. Although this could prevent damage to the structure, it would not discourage the stunts because it is still possible to carry out the stunt, only now the skater would slide along the rail instead of along the edge of the structure. Furthermore, railings are inappropriate in some situations, such as when the structure is a stair or set of stairs or a large planter.

Another way of discouraging these stunts is by placing large objects, for example flower pots, loosely along the top of the structure. Flower pots, however, could be easily removed by simply picking them up and moving them. Moreover, the flower pots may be aesthetically unpleasant or inappropriate for the setting, and may require maintenance. The flower pots could also interfere with desired uses of the structure, as in the case of stairs where the objects could get in the way of persons trying to walk up or down the stairs.

There is no convenient, easy-to-use and aesthetically pleasing device or method to prevent damage and degradation of structural comers due to objects sliding along their edges. There is thus a need for such a device and method.

SUMMARY OF THE INVENTION

In accordance with the present invention, a protection device is provided for restricting an object from sliding along an edge formed by a pair of surfaces of a structure. The protection device includes an obstruction fixture having a mounting surface and a body projecting away from the mounting surface. The protection device also includes some securing structure, such as a fastener or an adhesive, for securing the mounting surface to at least one of the surfaces of the structure. The obstruction fixture is positioned on the structure with the body positioned sufficiently close to the edge such that the object sliding along the edge will contact the body.

DETAILED DESCRIPTION OF THE INVENTION

Figure 1:
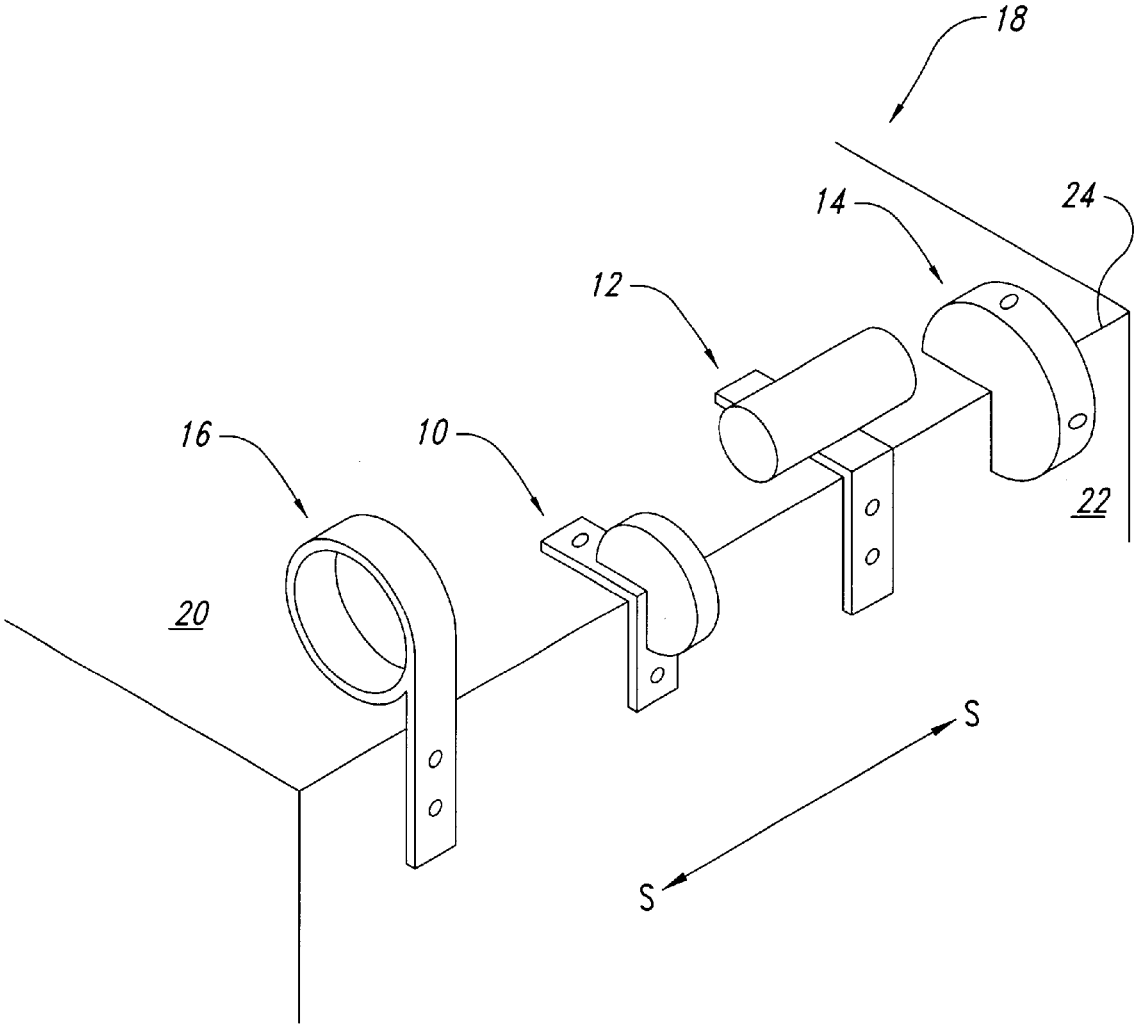
FIG. 1 is an isometric view showing four embodiments of the present invention in their mounted positions on a structure.

FIG. 1 illustrates four embodiments of protection devices 10, 12, 14, and 16 according to the present invention. Each protection device rests on a structure 18 having a horizontal surface 20, a vertical surface 22, and an edge 24 formed by the intersection of the vertical and horizontal surfaces. Although shown as a sharp edge, the edge 24 could also be a rounded or beveled edge. Similarly, the horizontal surface 20 and vertical surface 22 need not be perpendicular to each other. The protection devices are positioned astride or near the edge 24 to restrict objects, such as skateboards or inline skates, from sliding along the edge 24 in the direction S—S. The protection devices 10, 12 and 14 are positioned astride the edge 24 and are attached to one or both of the surfaces 20 or 22. As explained further below, the protection device 16 can either be positioned such that it sits astride the edge 24, as shown in FIG. 1, or such that it sits near, but not astride, the edge 24 and is attached to only one of the surfaces 20 or 22.

Figure 2A:
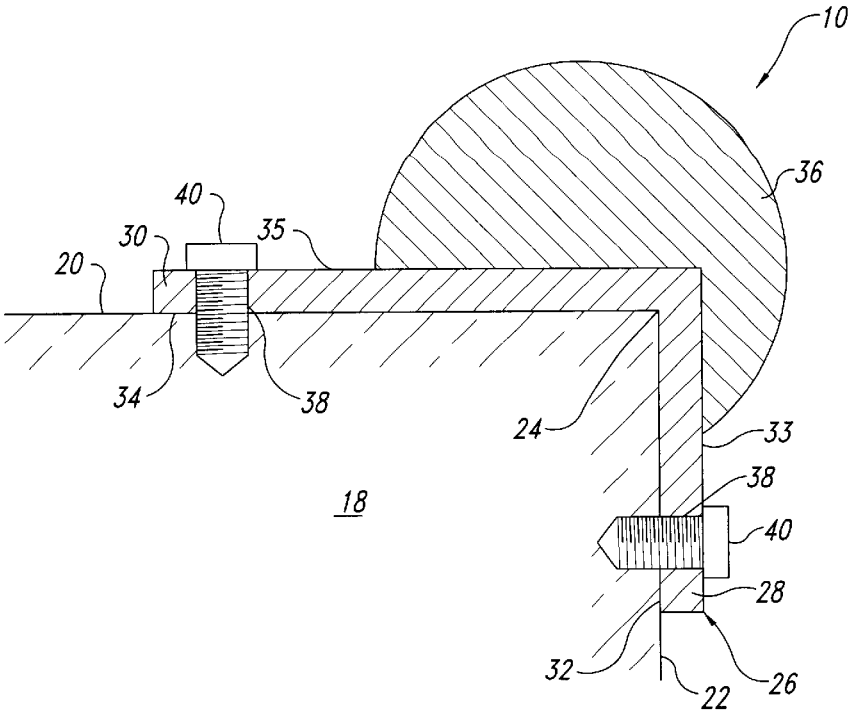
FIG. 2A is a side elevational view of one of the embodiments of the invention shown in FIG. 1.
Figure 2B:
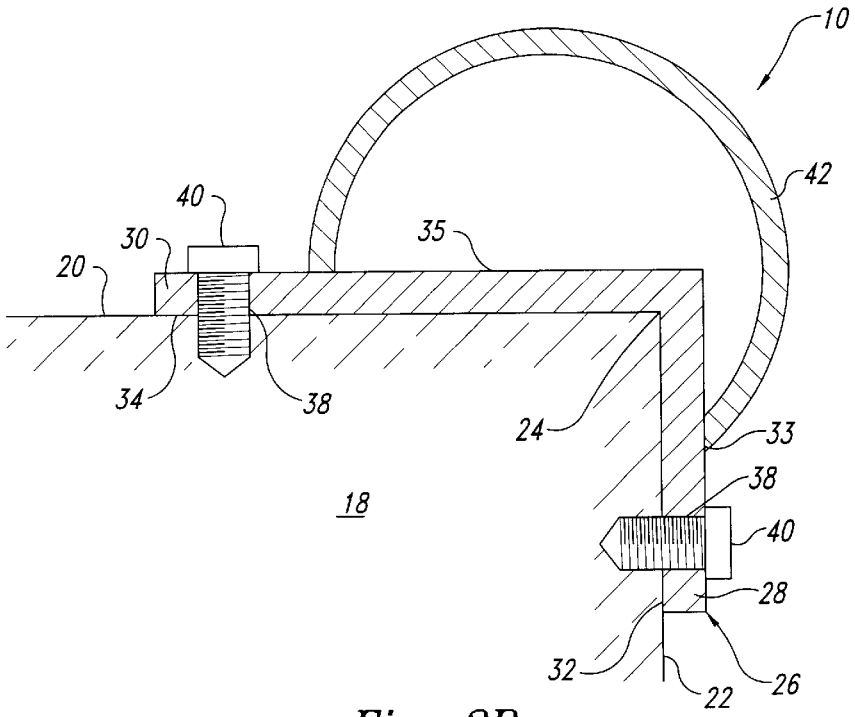
FIG. 2B is a side elevational view of an alternative of the embodiment shown in FIG. 2A.

FIGS. 2A–2B illustrate alternative embodiments of the protection device 10 shown in FIG. 1. As shown in FIG. 2A, the protection device 10 includes as its main components a mounting bracket 26 and a solid circular body 36. The mounting bracket 26 is L-shaped with a vertical leg 28 and a horizontal leg 30. The vertical leg 28 has a vertical mounting surface 32 and a vertical exposed surface 33, while the horizontal leg 30 has a horizontal mounting surface 34 and a horizontal exposed surface 35. Holes 38 in one or both legs of the mounting bracket 26 provide for attachment of the entire protection device to the structure 18. A solid circular body 36 is attached to the exposed surfaces 33 and 35 of the mounting bracket 26. The body 36 may be attached to the exposed surfaces by a variety of methods, including welding, unitary forming, or fusing. Both the body 36 and the mounting bracket 26 may be made of a variety of materials including metals such as iron, steel, brass, and bronze, or high-strength plastics. The body and bracket need not be made of the same material. FIG. 2B shows an alternative embodiment of the protection device 10 having an identical mounting bracket 26, but having a body 42 that is annular or hollow rather than solid.

To install the protection device 10, the mounting bracket 26 is placed astride the edge 24 such that the horizontal mounting surface 34 contacts the horizontal surface 20 and the vertical mounting surface 32 contacts the vertical surface 22. Fasteners 40 are inserted in the holes 38 and fastened to one or both of the horizontal surface 20 and vertical surface 22, thus securing the entire fixture 10 to the structure 18. Note that although the edge 24 is shown as a sharp edge, the protection device 10 could just as easily be installed on a rounded or beveled edge.

Figure 3A:
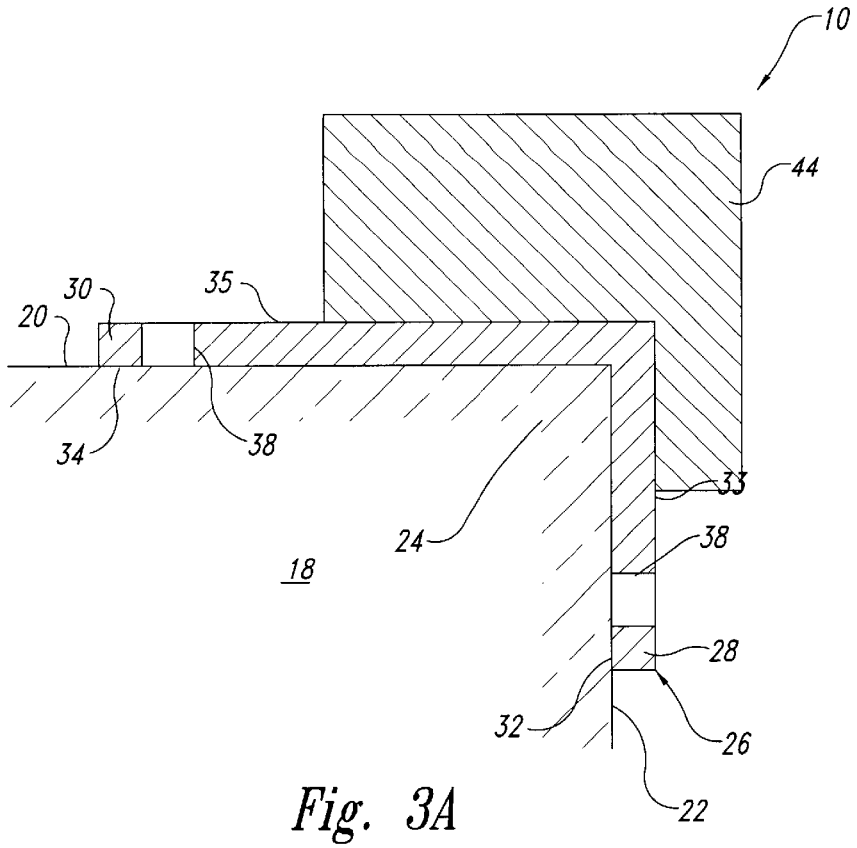
FIG. 3A is a side elevational view of another alternative of the embodiment shown in FIG. 2A.
Figure 3B:
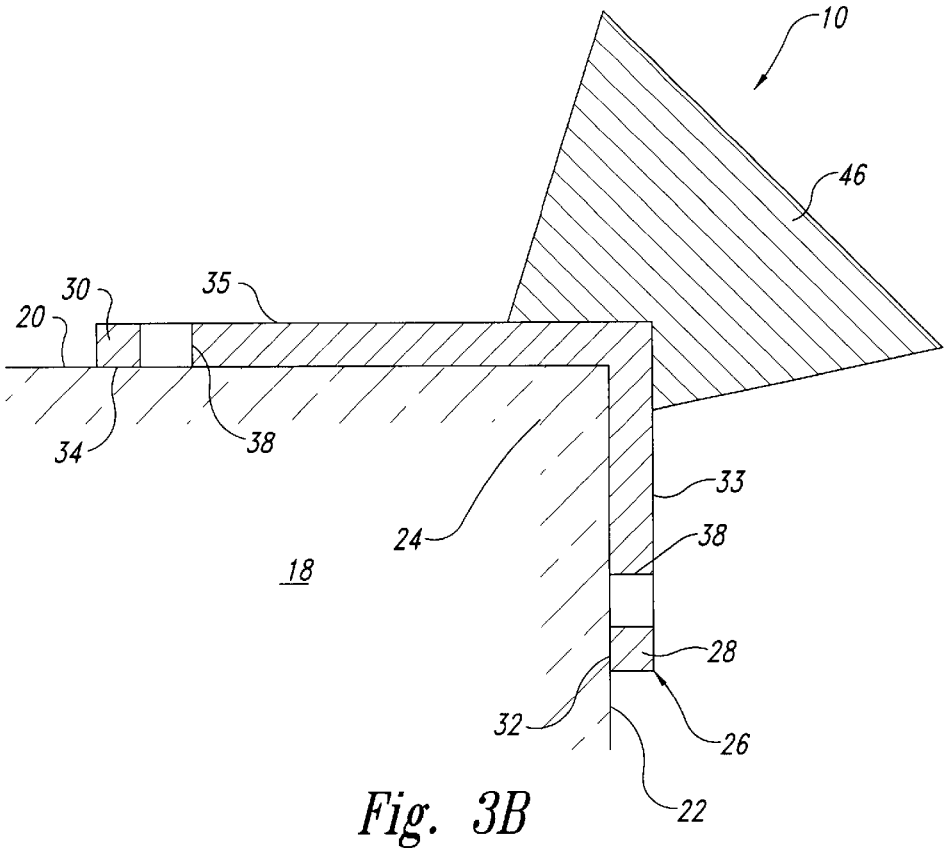
FIG. 3B is a side elevational view of a third alternative of the embodiment shown in FIG. 2A.

FIGS. 3A and 3B illustrate two further embodiments of the protection device 10. The mounting brackets 26 are identical to those shown in FIGS. 2A and 2B; the only difference is the shape of the body. FIG. 3A shows a protection device 10 with a solid body 44 that is square, while FIG. 3B shows a solid body 46 that is triangular.

Figure 4A:
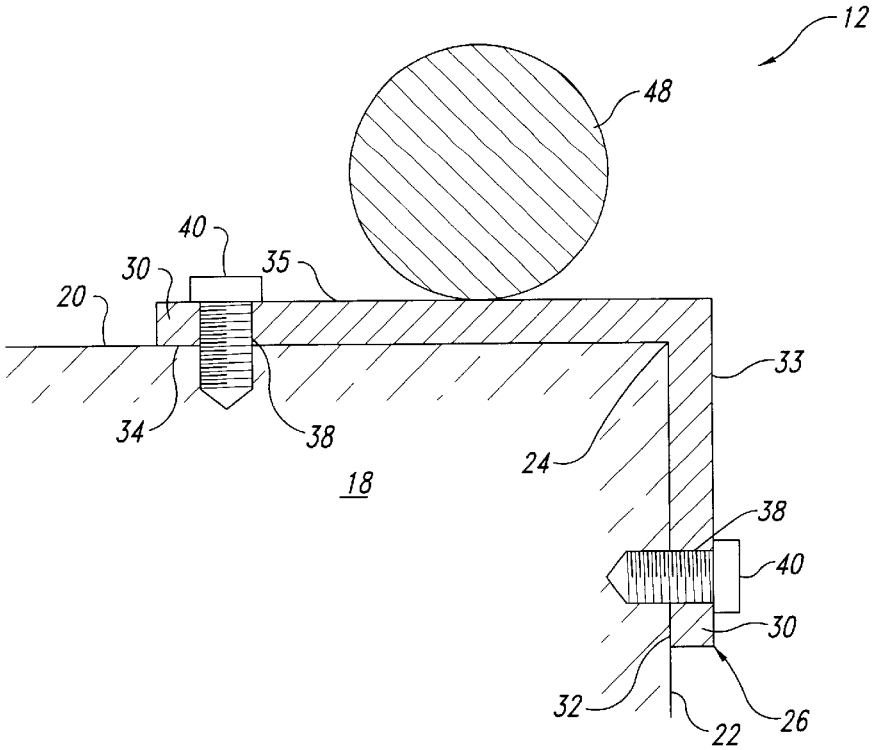
FIG. 4A is a side elevational view of another one of the embodiments of the invention shown in FIG. 1.
Figure 4B:
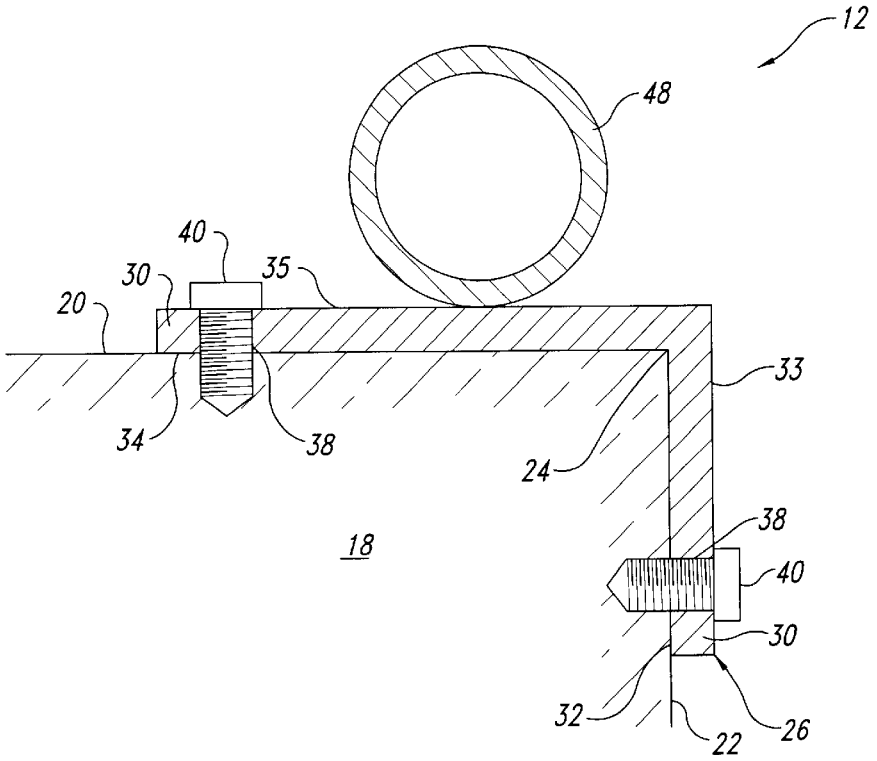
FIG. 4B is a side elevational view of an alternative of the embodiment shown in FIG. 4A.

FIGS. 4A–4B illustrate alternative embodiments of the protection device 12 shown in FIG. 1. The protection device 12 includes a mounting bracket 26 identical to the mounting bracket used in the protection device 10 (FIGS. 2A–2B, and 3A–3B). The principal difference between protection devices 12 and 10 is in the size, shape, and placement of the body. FIG. 4A shows a version of the embodiment 12 having a solid cylindrical body 48 attached to the exposed horizontal surface 35 of the horizontal leg 30 of the bracket 26. FIG. 4B illustrates an alternative embodiment of the protection device 12 where the body 48 is a hollow cylinder rather than a solid cylinder as shown in FIG. 4A.

Figure 5A:
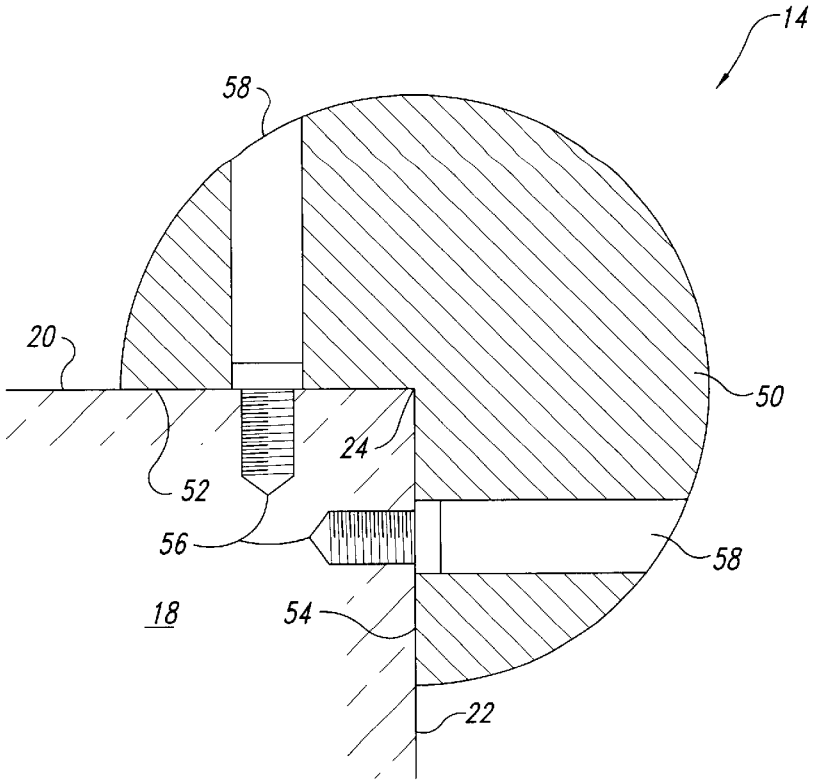
FIG. 5A is a side elevational view of a third one of the embodiments of the invention shown in FIG. 1.
Figure 5B:
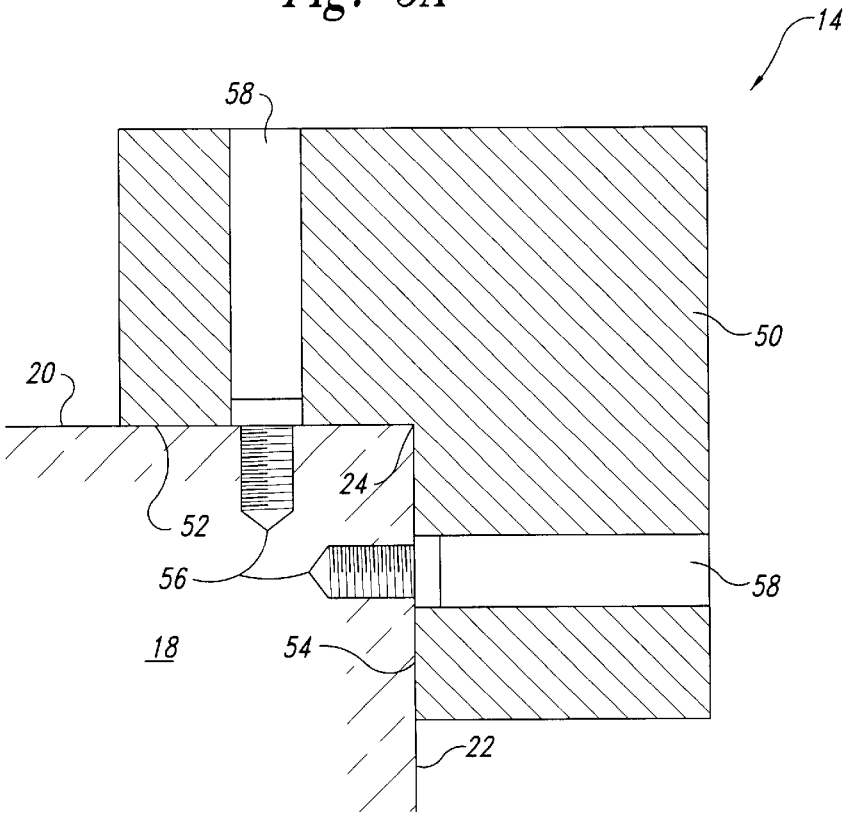
FIG. 5B is a side elevational view of an alternative of the embodiment shown in FIG. 5A.

FIGS. 5A and 5B illustrate alternative embodiments of the protection device 14 shown in FIG. 1. The protection device 14 is similar to devices 10 and 12 except that it includes no mounting bracket. Instead, the protection device 14, including a body 50, is directly mounted on the edge 24 of the structure. As shown in FIG. 5A, the body 50 is a solid circle with one quadrant removed. When the quadrant is removed from the body 50, a horizontal mounting surface 52 and a vertical mounting surface 54 are formed. Holes 58 extend between the mounting surfaces and the circular perimeter of the body 50 to receive fasteners 56 for attaching the protection device to the structure. FIG. 5B illustrates an alternative embodiment of the protection device 14 where the body 50 is a solid quadrilateral rather than a solid circle as shown in FIG. 5A.

The protection device 14 is installed in the same way as the devices 10 and 12. The body 50 is placed astride the edge 24 of the structure, with the mounting surface 52 in contact with the horizontal surface 20 and the mounting surface 54 contacting the vertical surface 22. Fasteners 56 are inserted into the holes 58 to engage the horizontal and vertical surfaces, thus securing the protection device 14 to the structure 18.

Figure 6A:
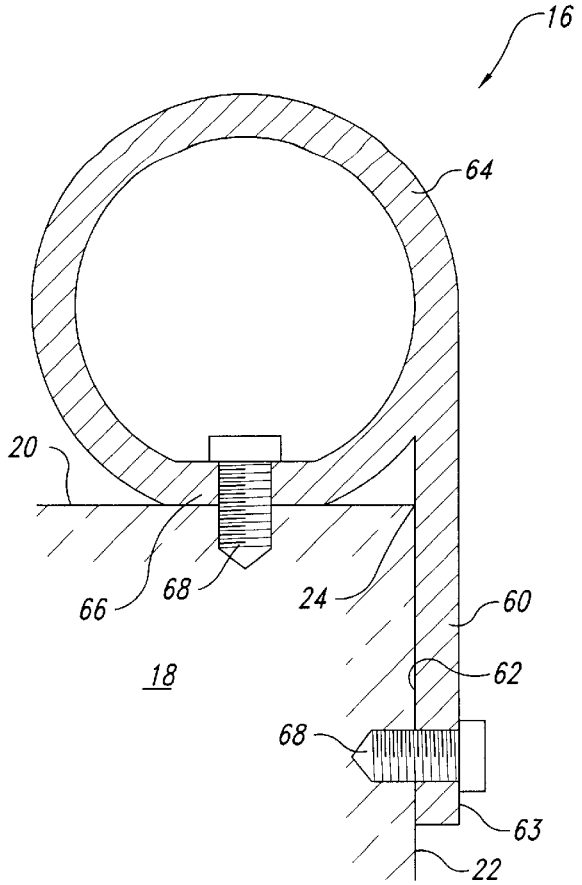
FIG. 6A is a side elevational view of a fourth one of the embodiments of the invention shown in FIG. 1 installed in a first manner.
Figure 6B:
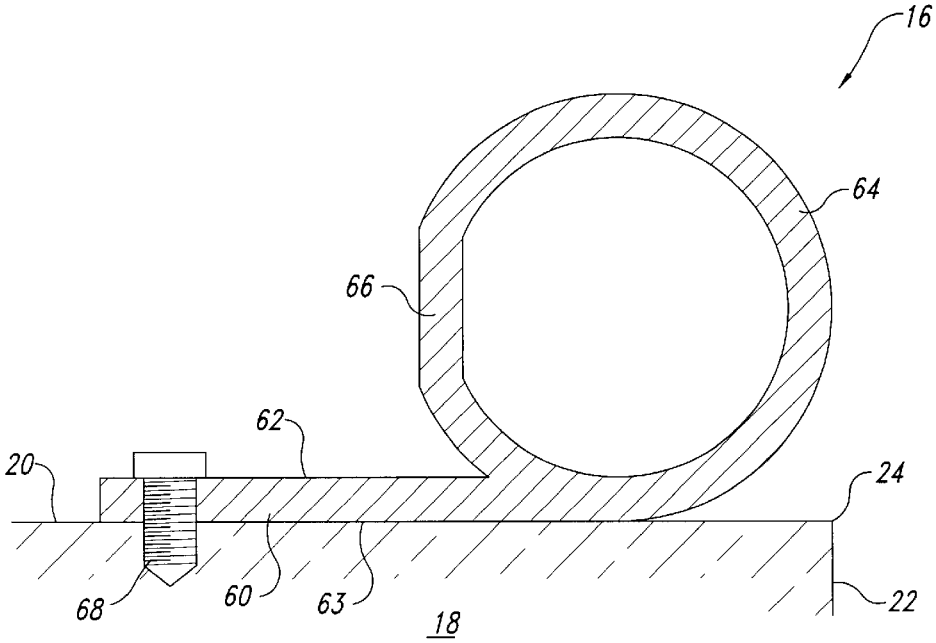
FIG. 6B is a side elevational view of the embodiment shown in FIG. 6A, installed in an alternate manner.

FIGS. 6A and 6B illustrate the protection device 16 installed in two different positions on the structure 18. As shown in FIG. 6A, the protection device 16 includes as its main components a flange 60 and a body 64 attached to and projecting from the flange 60. The flange has a mounting surface 62 and an exposed surface 63. The body 64 is generally circular with the exception of a flat portion 66. As with the previous embodiments, the body 64 can be attached to the flange 60 by welding, fusing, or unitary construction, and the device 16 can be made of metals such as iron, steel, brass, or bronze, or can be made of a rigid plastic or some other material. To install the protection device 16, the device is positioned astride the edge 24 of the structure with the mounting surface 62 fully in contact with the surface 22 and the straight portion 66 of the body in contact with the horizontal surface 20. The protection device 16 is then fastened to the structure 18 using fastener 68.

FIG. 6B shows an alternative way of installing the protection device 16. The primary difference between this installation and the one shown in FIG. 6A is that the device 16 in FIG. 6B is near, but not astride, the edge 24. In this installation, the exposed surface 63 of the flange 60 is placed in contact with the horizontal surface 20, such that the protection device 16 projects away from the horizontal surface 20 and is close enough to the edge 24 to restrict an object from sliding along the edge. The protection device 16 is secured to the horizontal surface 20, and thus to the structure 18, using one or more fasteners 68. Although one fastener is shown, more may be used.

Figure 7:
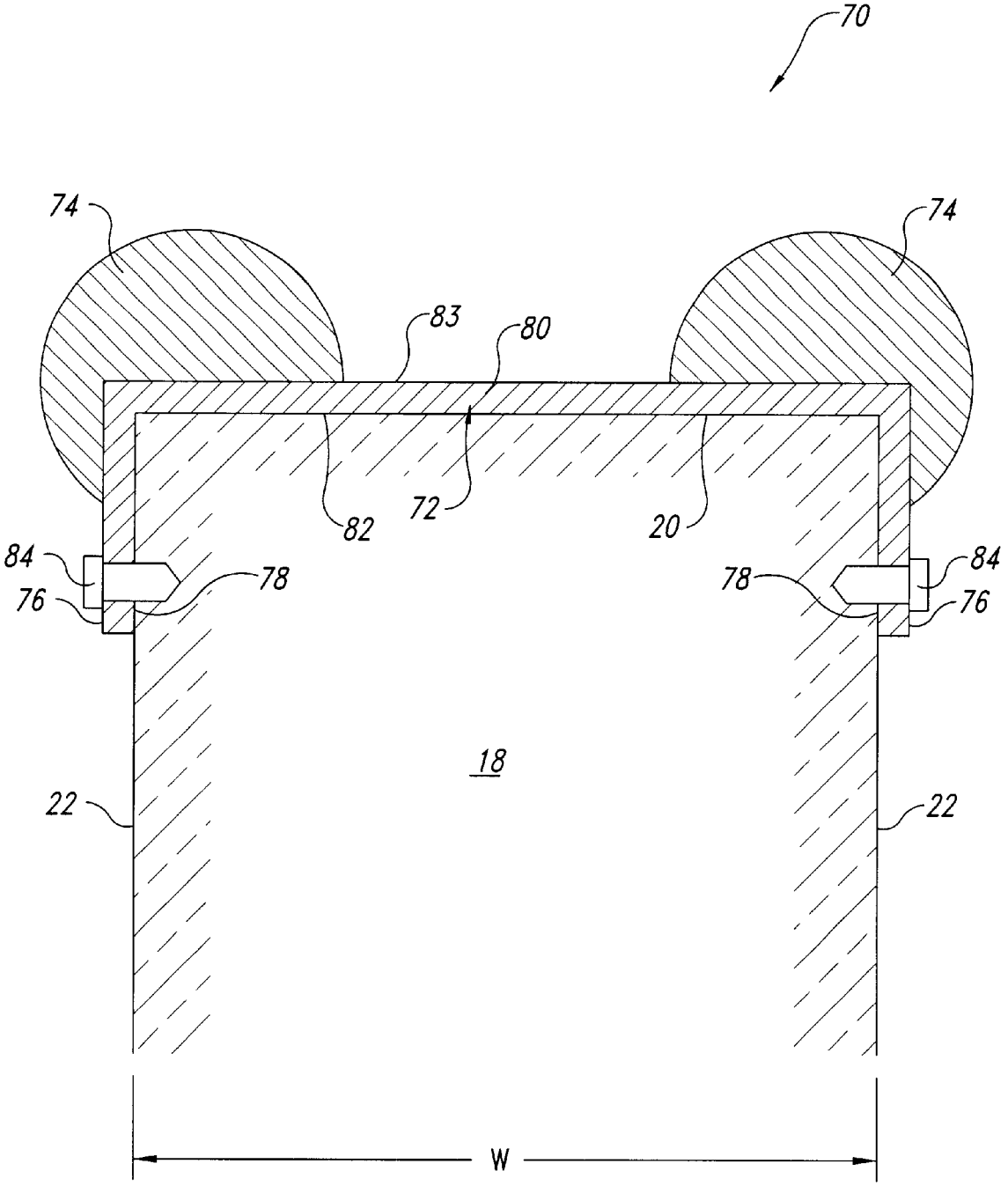
FIG. 7 is an isometric view of another embodiment of the invention.

FIG. 7 illustrates a protection device 70 suitable for use on a structure 18 having two edges 24 separated by a width W. The protection device 70 includes a mounting bracket 72 and two bodies 74 attached to the mounting bracket. The mounting bracket 72 has two vertical flanges 76 with a mounting surfaces 78, and a horizontal flange 80 with a mounting surface 82 and an exposed surface 83. The vertical flanges 76 are attached to the ends of the horizontal flange 80 and are substantially perpendicular thereto. The length of the horizontal flange 80 is equal to the width W of the structure 18. The two bodies 74 are positioned at the intersections of the vertical flanges 76 and the horizontal flange 80, and are attached to the exposed surfaces of the horizontal flange 80 and the vertical flanges 76 in the same way that the bodies were attached to mounting brackets in the previous embodiments.

To install the protection device 70, the device is placed on top of the structure 18 with the mounting surface 82 of the horizontal flange 80 in contact with the horizontal surface 20, and the mounting surfaces 78 of the vertical flanges 76 in contact with the vertical surfaces 22 of the structure 18. Once in position, the protection device 70 is secured using fasteners 84. Although the fasteners 84 are shown inserted into the vertical flanges 76 and the vertical surfaces 22 of the structure 18, they can equally well be inserted through the horizontal flange 80 and into the horizontal surface 20 of the structure 18. As with the other embodiments, the bodies 74 need not be circular and may take on any other shape, such as quadrilaterals or triangles.

Figure 8A:
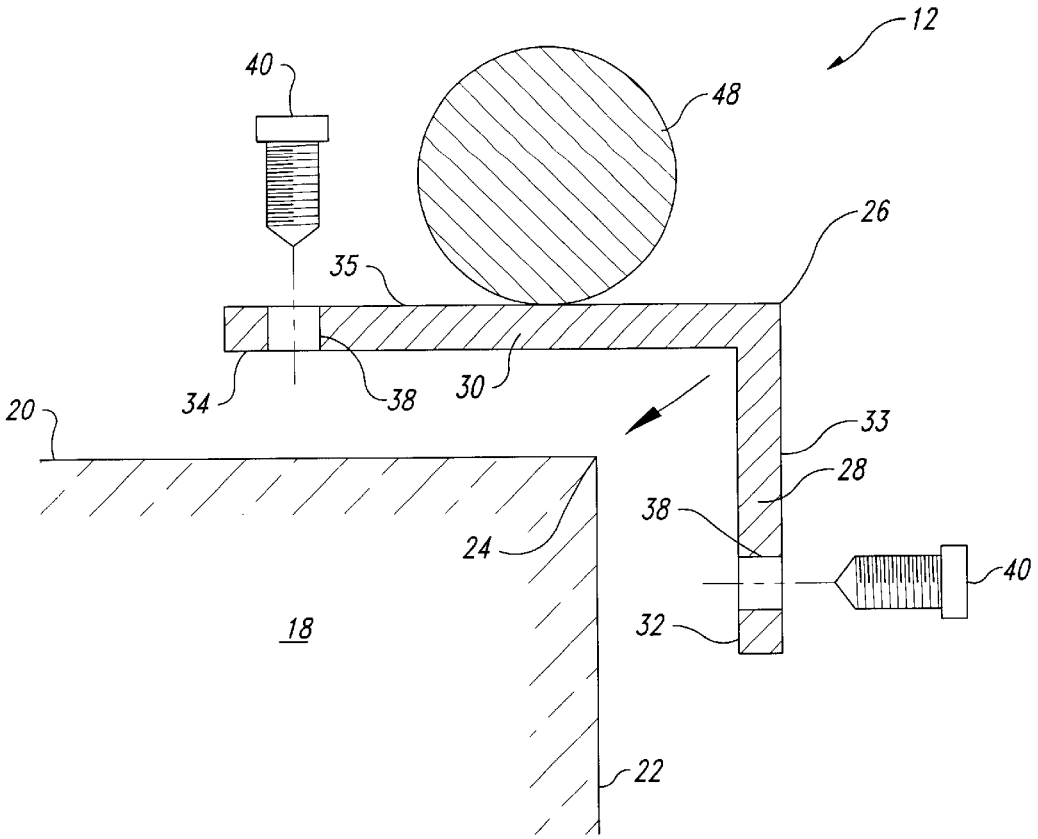
FIGS. 8A–8B are side elevational views showing the steps of mounting the inventive protection devices.
Figure 8B:
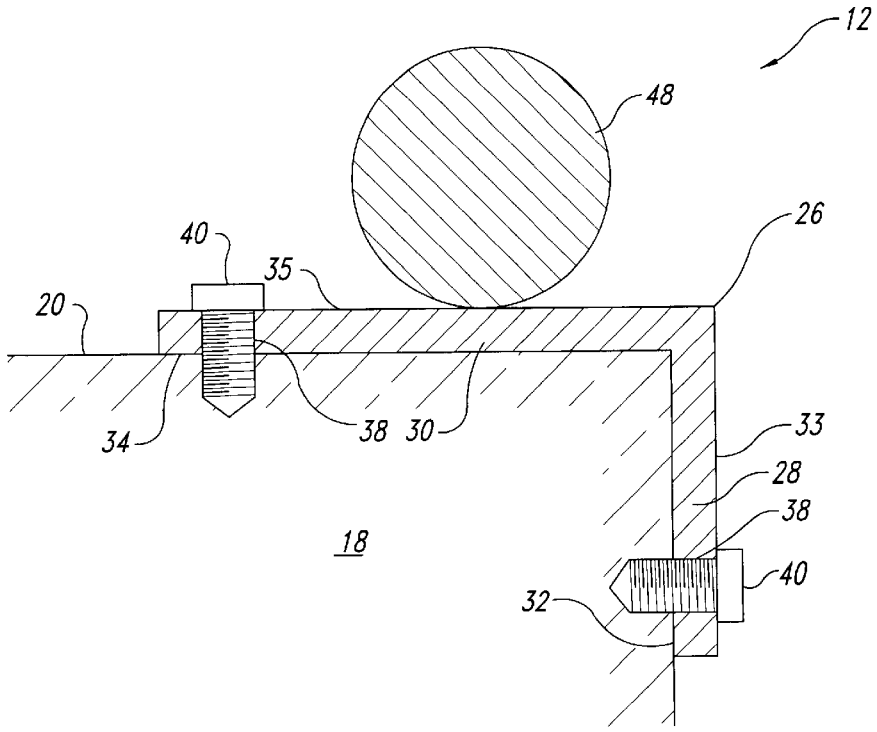

FIGS. 8A and 8B illustrate a method of installing the protection device 12 of FIGS. 1 and 4 on the edge 24 of the structure 18. However, the method of installation is similar for the other embodiments. To install the protection device 12, the device is first positioned astride the edge 24 of the structure 18, as shown in FIG. 8A. The bracket 26 is positioned astride the edge 24 such that the mounting surface 34 of the horizontal leg of the bracket 26 is in contact with the horizontal surface 20 and the vertical mounting surface 32 of the vertical leg of the mounting bracket 26 is in contact with the vertical surface 22. Once the protection device 12 is properly positioned, as shown in FIG. 8B, fasteners 40 are inserted through holes 38 in the vertical and horizontal flanges, thus securing the protection device 12 to the structure 18. The fasteners are inserted through holes in the vertical flange and horizontal flange, with each fastener extending into the horizontal surface 20 and vertical surface 22, respectively.

Although the above-described embodiments of the invention have been described as including fasteners to secure the protection devices to the surfaces, it will be understood that other fastening techniques may be used. For example, an adhesive, such as epoxy or glue, may be used in place of or in addition to one or more fasteners. Furthermore, a single fastener such as a bolt, may be used in combination with a pin that projects into an adjacent surface from a portion of the protection device that is perpendicular to the portion receiving the fastener. Alternatively, one or more mounting pairs can be used in combination with an adhesive. Other fastening techniques that may be used will be apparent to one skilled in the art.

Figure 9:
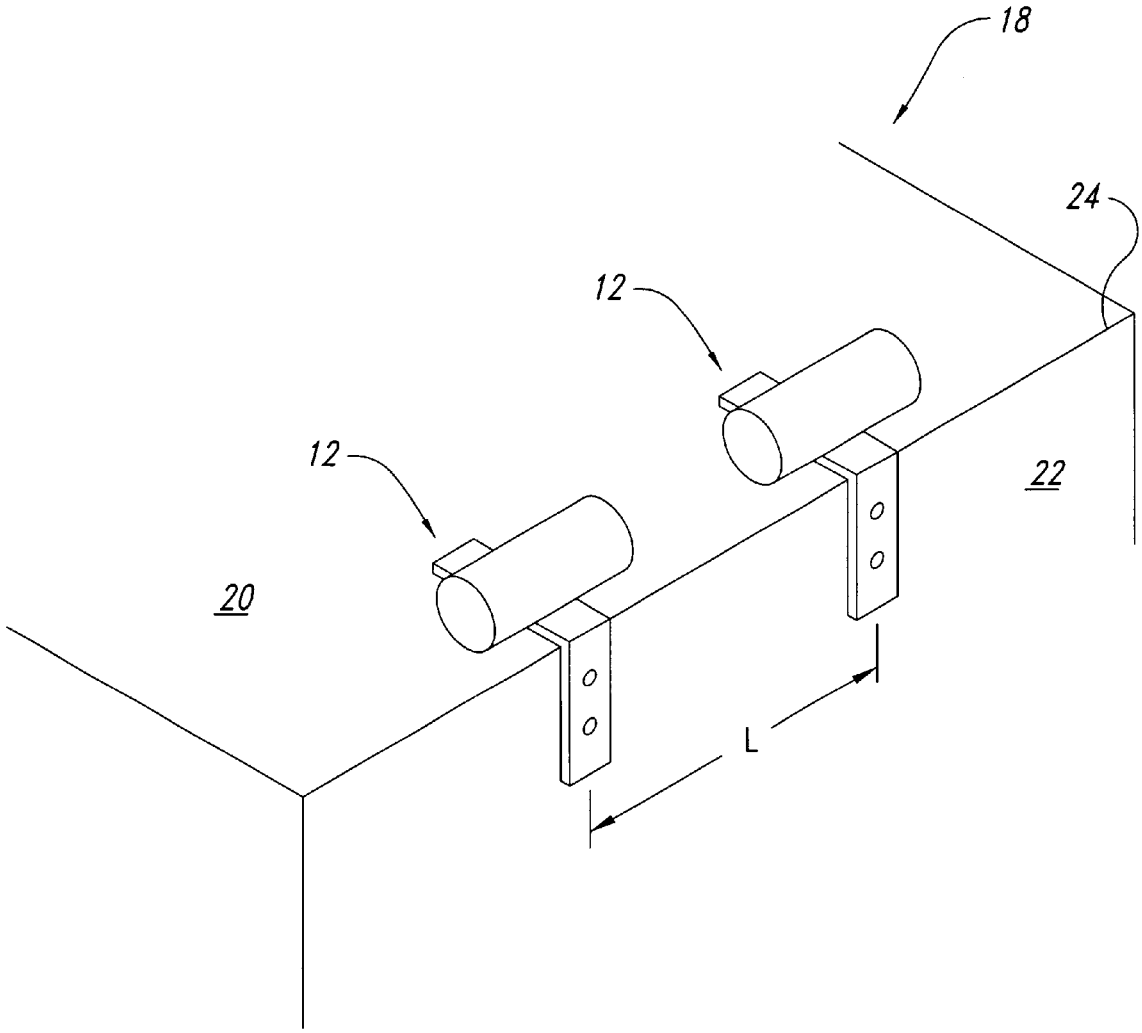
FIG. 9 is an isometric view of a system for protecting structural edges using the protection devices.

As shown in FIG. 9, the system includes a series of protection devices 12 installed as shown in FIGS. 8A and 8B along the edge 24 of the structure 18. The protection devices 12 are positioned along the edge 24 with a distance L between them, the distance L being chosen to restrict sliding motion along the edge 24. Skateboarders and in-line skaters are thereby prevented, or at least discouraged, from performing their stunts.

Figure 10A:
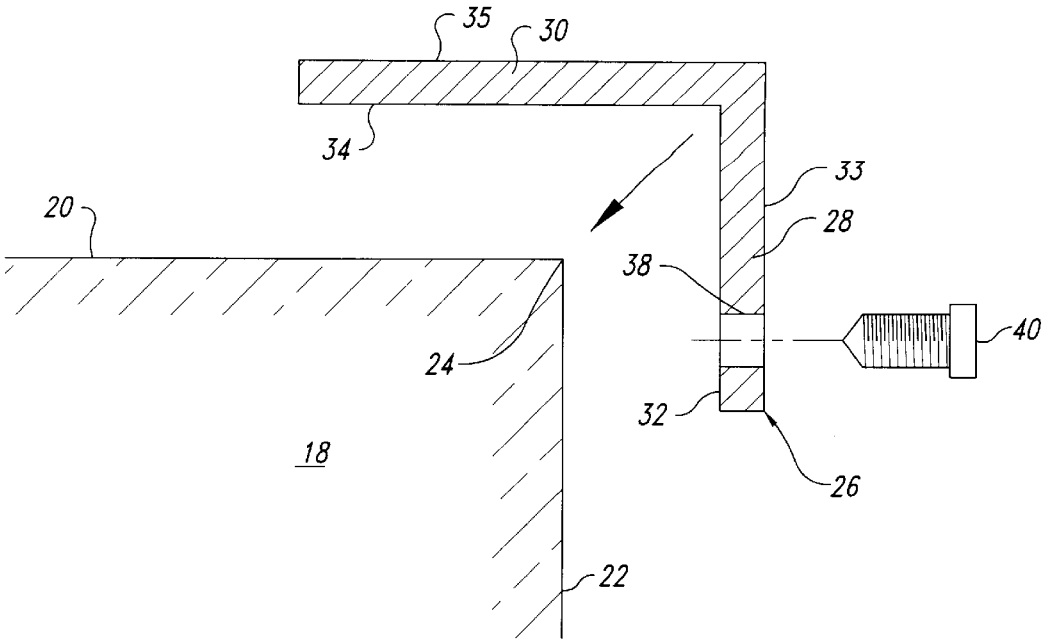
FIGS. 10A–10C are side elevational views showing an alternative method for mounting the inventive protection devices.
Figure 10B:
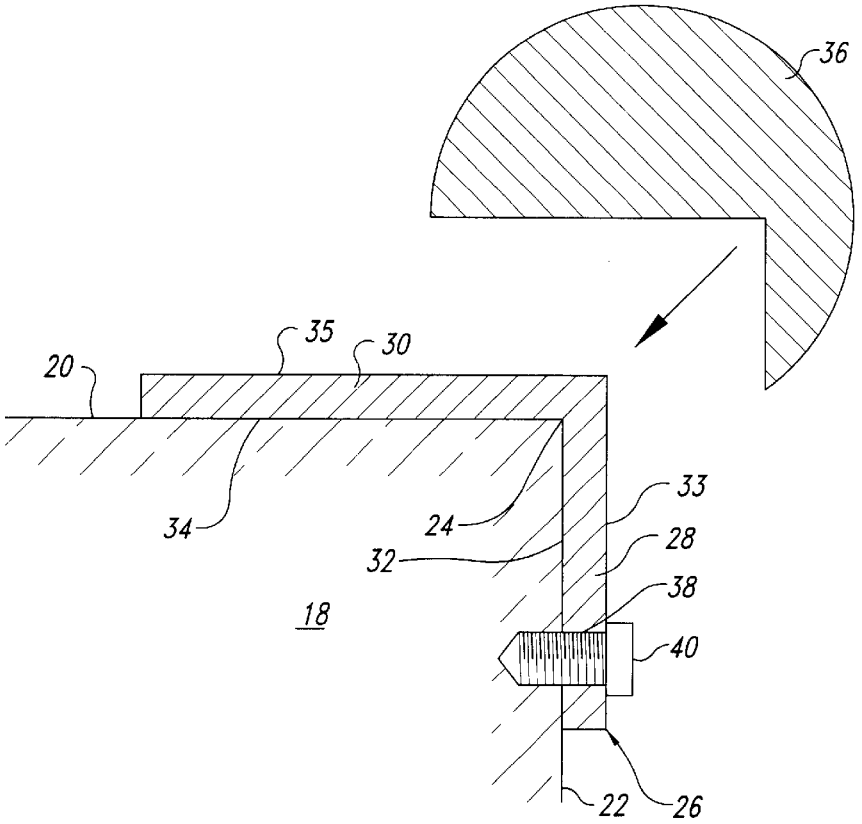
Figure 10C:
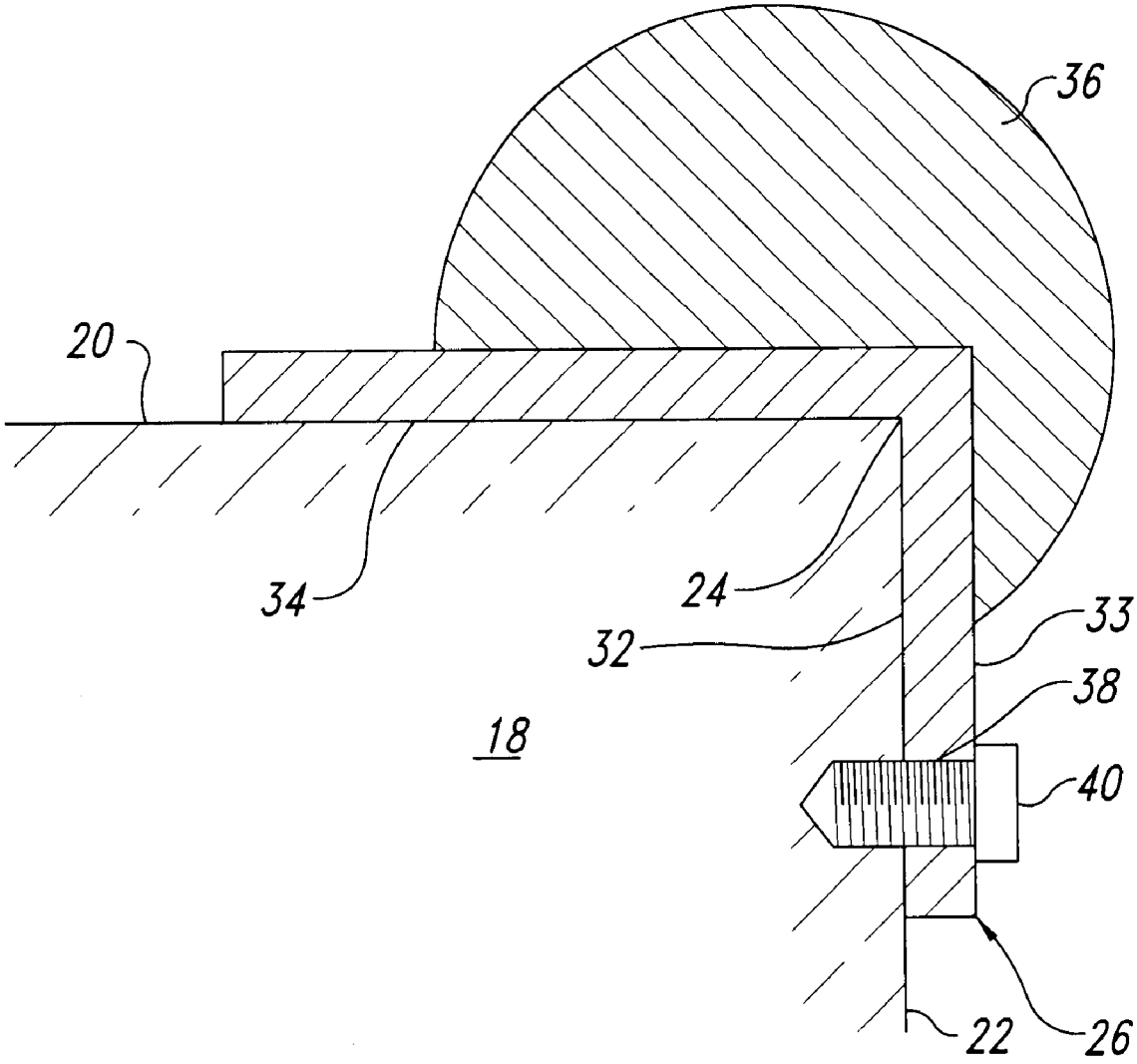

FIGS. 10A–10C illustrate an alternative method of restricting sliding motion along the edge 24 using one or more protection devices. The protection device 10 shown in FIGS. 1 and 2 is used as an example. In this method, the mounting bracket 26 is first positioned astride the edge 24 of the structure 18. The mounting bracket 26 is positioned such that the vertical mounting surface 32 contacts the vertical surface 22 and the horizontal mounting surface 34 contacts the horizontal surface 20. The fastener 40 is inserted through the hole 38 and into the vertical surface 22 as shown in FIG. 10B, thus securing the mounting bracket 26 to the structure 18. Once the mounting bracket is secured, the body 36 is positioned such that it is astride the mounting bracket 26 and is placed on the mounting bracket such that it is in contact with the exposed surfaces of the vertical and horizontal flanges. The protection device 10 in its final position is shown in FIG. 10C, with the mounting bracket 26 firmly attached to the structure 18 and the body 36 firmly attached to the mounting bracket 26. Several devices 10 may be attached to the structure in this way to protect the edge as shown in FIG. 9.

From the foregoing it will be appreciated that, although specific embodiments of the invention have been described herein for purposes of illustration, various modifications may be made without deviating from the spirit and scope of the invention. For example, it may be possible to use the mounting bracket 26 of FIG. 2 without the body 36, particularly if the bracket 26 is sufficiently thick to prevent a skateboard or in-line skates from sliding along the edge 24. Accordingly, the invention is not limited except as by the following claims.

What is claimed is:

1. A system for restricting an object from sliding along a substantially horizontal edge formed by a substantially horizontal surface intersecting a substantially vertical surface of a structure, the system comprising a plurality of protection devices attached to the structure with each of the protection devices overlying the substantially horizontal edge and extending along the substantially horizontal surface and the substantially vertical surface, the protection devices being spaced along the substantially horizontal edge at intervals selected to prevent objects from sliding along the edge, each protection device comprising: an obstruction fixture having a body possessing a circular cross section attached to a mounting bracket which is secured to the vertical and horizontal surfaces of the structure with the body of the obstruction fixture positioned astride the edge so that the object sliding along the edge will contact the body of the obstruction fixture; with each protection device extending along the substantially horizontal surface in a first direction perpendicular to the substantially vertical surface a distance that is less than half of the width of the substantially horizontal surface in the first direction and extending along the substantially vertical surface in a second direction perpendicular to the substantially horizontal surface a distance that is less than half of the height of the substantially vertical surface in the second direction.

2. The system of claim 1 wherein the attaching structure comprises at least one fastener extending into the structure.

3. The system of claim 1 wherein the obstruction fixture is positioned astride the edge.

4. The system of claim 1 wherein the mounting structure comprises a bracket having one flange, the body being attached to the bracket.

5. The system of claim 1 wherein the mounting structure comprises a bracket having two flanges, at least one of which is attached to one of the surfaces, the body being attached to at least one of the flanges.

6. The system of claim 5 wherein the body projects away from one of the flanges.

7. The system of claim 5 wherein the body projects away from both of the flanges.

8. The system of claim 1 wherein the body has a solid circular cross section.

9. The system of claim 1 wherein the body has an annular cross section.

10. A method of restricting an object from sliding along a substantially horizontal edge formed by a substantially horizontal surface intersecting a substantially vertical surface of a structure, the method comprising securing a plurality of protection devices to the structure with each of the protection devices overlying the substantially horizontal edge and extending along the substantially horizontal surface and the substantially vertical surface, each protection device comprising: an obstruction fixture having a body possessing a circular cross section attached to a mounting bracket; securing the mounting bracket to the vertical and horizontal surfaces of the structure with the body of the obstruction fixture positioned astride the edge so that the object sliding along the edge will contact the body of the obstruction fixture; with each protection device extending along the substantially horizontal surface in a first direction perpendicular to the substantially vertical surface a distance that is less than half of the width of the substantially horizontal surface in the first direction and extending along the substantially vertical surface in a second direction perpendicular to the substantially horizontal surface a distance that is less than half of the height of the substantially vertical surface in the second direction, the protection devices being secured to the structure at intervals chosen to restrict sliding motion along the edge.

* * * * *